US009941670B2

(12) United States Patent
Tanaya

(10) Patent No.: US 9,941,670 B2
(45) Date of Patent: Apr. 10, 2018

(54) DISCHARGE DEVICE

(71) Applicant: Mitsubishi Electric Corporation, Tokyo (JP)

(72) Inventor: Kimihiko Tanaya, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/260,909

(22) Filed: Sep. 9, 2016

(65) Prior Publication Data

US 2017/0331262 A1 Nov. 16, 2017

(30) Foreign Application Priority Data

May 10, 2016 (JP) ..... 2016-094272

(51) Int. Cl.
*H01T 19/00* (2006.01)

(52) U.S. Cl.
CPC ..... *H01T 19/00* (2013.01)

(58) Field of Classification Search
CPC ... F02N 2300/2011; F02P 17/00; F02P 19/02; F02P 23/04; F02P 3/0407; F02P 5/1502; F02P 3/01; F02P 3/04; F02P 9/002; F02P 19/00; F02P 3/0442; F02P 3/0876; F02P 11/06; F02P 9/007; F02P 17/12; G01M 15/02; G01N 27/02; H01T 15/00; H01T 19/00; H01T 13/50; H01T 19/02; H02M 3/00; H03F 3/45076; F23Q 3/004; F02B 3/06; F02B 3/00; F02D 2041/2003; F02D 41/28; F02D 2041/288; H03L 7/00; H03B 5/08

See application file for complete search history.

(56) References Cited

U.S. PATENT DOCUMENTS

2006/0043909 A1* 3/2006 Hwang ..... H05B 41/2855 315/276
2010/0176736 A1* 7/2010 Lee ..... H05B 41/2855 315/209 R
2012/0249006 A1 10/2012 Burrows
2012/0249163 A1 10/2012 Burrows
(Continued)

FOREIGN PATENT DOCUMENTS

JP 2014-513760 A 6/2014

*Primary Examiner* — Alexander H Taningco
*Assistant Examiner* — Renan Luque
(74) *Attorney, Agent, or Firm* — Sughrue Mion, PLLC; Richard C. Turner

(57) ABSTRACT

A discharge device includes a power supply device supplying AC power for generating a discharge in a clearance to a discharge load having a high-voltage electrode and a grounding electrode arranged to face the high-voltage electrode with the clearance and connected to a ground GND and having a connection state detector detecting a connection state of an output path of AC power, and a controller controlling the power supply device by determining the existence of an abnormality in the connection state and deciding whether AC power can be supplied or not. In the case where a disconnection or a connection failure occurs in the output path of AC power to be supplied from the discharge device to the discharge load, apparatuses included in the discharge device are protected from damage as well as occurrence of a secondary disaster can be prevented and suppressed.

11 Claims, 6 Drawing Sheets

(56) References Cited

U.S. PATENT DOCUMENTS

| | | | | |
|---|---|---|---|---|
| 2014/0265880 | A1* | 9/2014 | Taipale | H05B 37/0263 315/158 |
| 2016/0084215 | A1* | 3/2016 | Kondou | F02P 3/0435 123/620 |

* cited by examiner

CONNECTION STATE; "NORMAL"
CONNECTION STATE; "ABNORMAL"
t0
t1
t2
t3
t4
401
402
Th1
Th2
VL
CONTROL SIGNAL A
CONTROL SIGNAL B
OUTPUT VOLTAGE

TIMING OF POWER SUPPLY TO DISCHARGE LOAD

CONTROL SIGNAL C

DISCHARGE DEVICE

BACKGROUND OF THE INVENTION

Field of the Invention

The present invention relates to a discharge device using discharge mainly by AC power which is used for, for example, fuel ignition in an internal-combustion engine.

Description of the Related Art

In recent years, problems of environmental conservation and fuel depletion are raised, and it is urgently necessary to take measures against these problems also in the automotive industry. As an example of these measures, there is a method of dramatically improving fuel consumption by reducing pumping loss (intake and exhaust loss) using EGR (Exhaust Gas Recirculation). However, the burnt gas as the exhaust gas is non-combustible and has a high heat capacity with respect to the air, therefore, there is a problem that ignitibility and combustibility are reduced when a large quantity of burnt gas is taken by the EGR.

As one of solutions for the problem, for example, in a corona discharge ignition system in JP-2014-513760A, a discharge method of igniting at multi-points and in a wide range using corona discharge to thereby form a stable flame kernel and to make combustibility be more stable. When using the disclosed ignition system, a more stable flame kernel can be formed as compared with a related-art ignition coil, and stable combustibility can be obtained, for example, when the large quantity of gas is inputted in the above EGR. Accordingly, a larger quantity of gas in the EGR can be inputted as compared with the related-art ignition system, and the pumping loss can be reduced, therefore, an internal-combustion engine capable of dramatically improving fuel consumption can be obtained.

In the related-art corona discharge ignition system of JP-2014-513760A, AC power is supplied to an ignition device 22 corresponding to an ignition plug as shown in FIG. 2. The electric current supplied to the ignition device 22 flows through a path of a high-voltage terminal 62 of a transformer 44, an inductor 27, the ignition device 22, a ground GND connecting to a current sensor 46, the current sensor 46 and the high-voltage terminal 62 of the transformer 44 in this order.

However, when the status of disconnection or connection failure occurs in the high-voltage terminal 62 of the transformer 44 in the corona discharge ignition system of JP-2014-513760A, there is a place where electrical capacitive coupling is made because a drive circuit 30 of the corona discharge ignition system is a device which outputs AC power. If there is a path for feeding back to a power generation source, AC current is outputted from the ignition device even when an original energizing path is disconnected, and the device is sometimes in a state as if it is normally operated. For example, the current may flow through a path of the high-voltage terminal 62 of the transformer 44, the inductor 27, the ignition device 22, the ground GND connecting to the current sensor 46, the current sensor 46, a low-pass filter 48, a square wave converter 50, an operational amplifier 38, a switch 42, a primary-side winding 66 of the transformer 44 and the high-voltage terminal 62 of the transformer 44 in this order.

In the case where a prescribed amount of current or more flows through the path, the operational amplifier, the switch or the like on the path may be damaged and the drive circuit may be broken, however, there is a case that an abnormality is not found just by observing a signal of the current sensor 46 as the drive circuit is operated in a near normal state.

SUMMARY OF THE INVENTION

The present invention has been made for solving the above problems and an object thereof is to protect apparatuses included in a discharge device from damage and to prevent and suppress the occurrence of a secondary disaster in the case where an output path of AC power to be supplied from the discharge device to a discharge load is disconnected or becomes in a state of connection failure.

According to an embodiment of the present invention, there is provided a discharge device including a power supply device supplying AC power to a discharge load including a high-voltage electrode and a grounding electrode arranged to face the high-voltage electrode with a clearance and connected to a ground GND and a controller controlling the supply of the AC power, in which the power supply device includes a power supply using a first internal GND as a reference, an output device outputting the AC power to the discharge load 101 by the power supply by using a second internal GND which is electrically separated from the first internal GND as a reference, and a connection state detector detecting a connection state between the second internal GND and the ground GND, and the controller determines the existence of an abnormality in the connection state based on an output of the connection state detector and decides whether the AC power can be supplied to the discharge load or not.

As the discharge device according to the present invention has a function of accurately determining the disconnection in the output path of the AC power to be supplied from the discharge device to the discharge load or occurrence of a malfunction causing a connection failure, therefore, advantages that apparatuses included in the discharge device are protected from damage by stopping the operation of the discharge device when the malfunction occurs and the occurrence of secondary disasters can be prevented and suppressed can be expected.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Hereinafter, the details of a structure and the operation of a discharge device according to embodiments of the present invention will be explained with reference to FIG. 1 to FIG. 6B.

Embodiment 1

Figure 1:
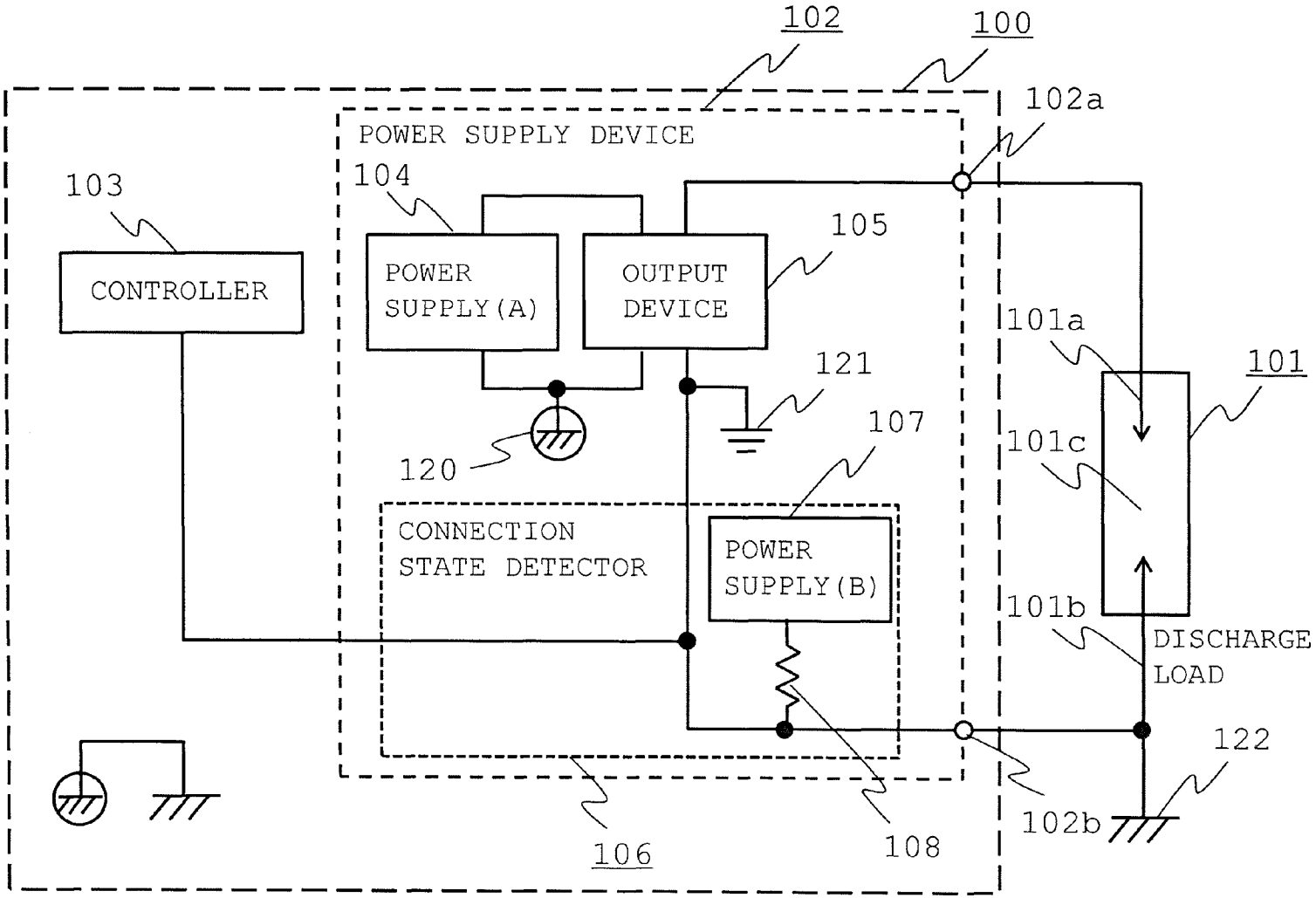
FIG. 1 is a circuit block diagram showing an outline of a structure of a discharge device according to Embodiment 1.
Figure 2:
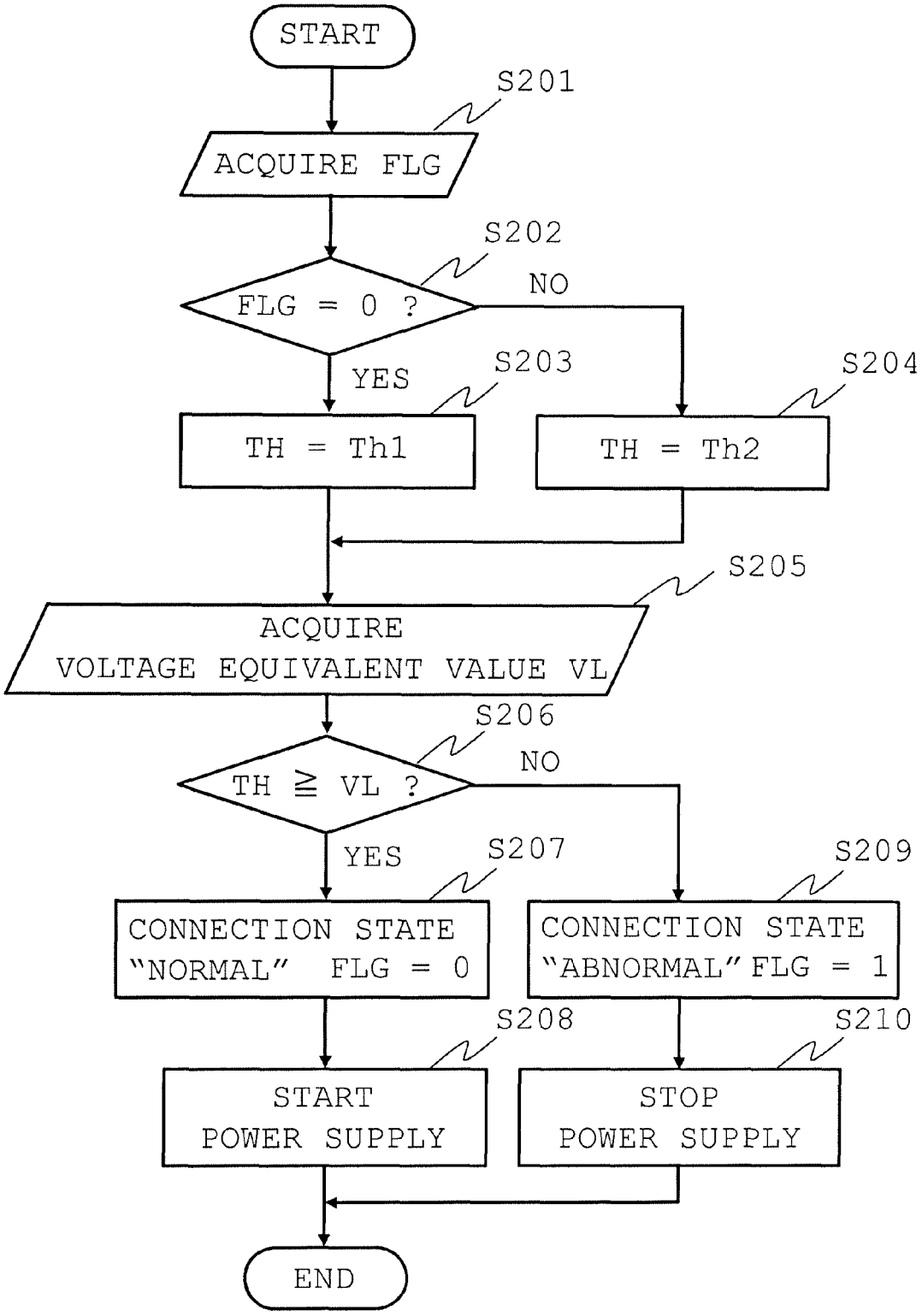
FIG. 2 is a flowchart showing an operation procedure of a controller according to Embodiment 1.
Figure 3:
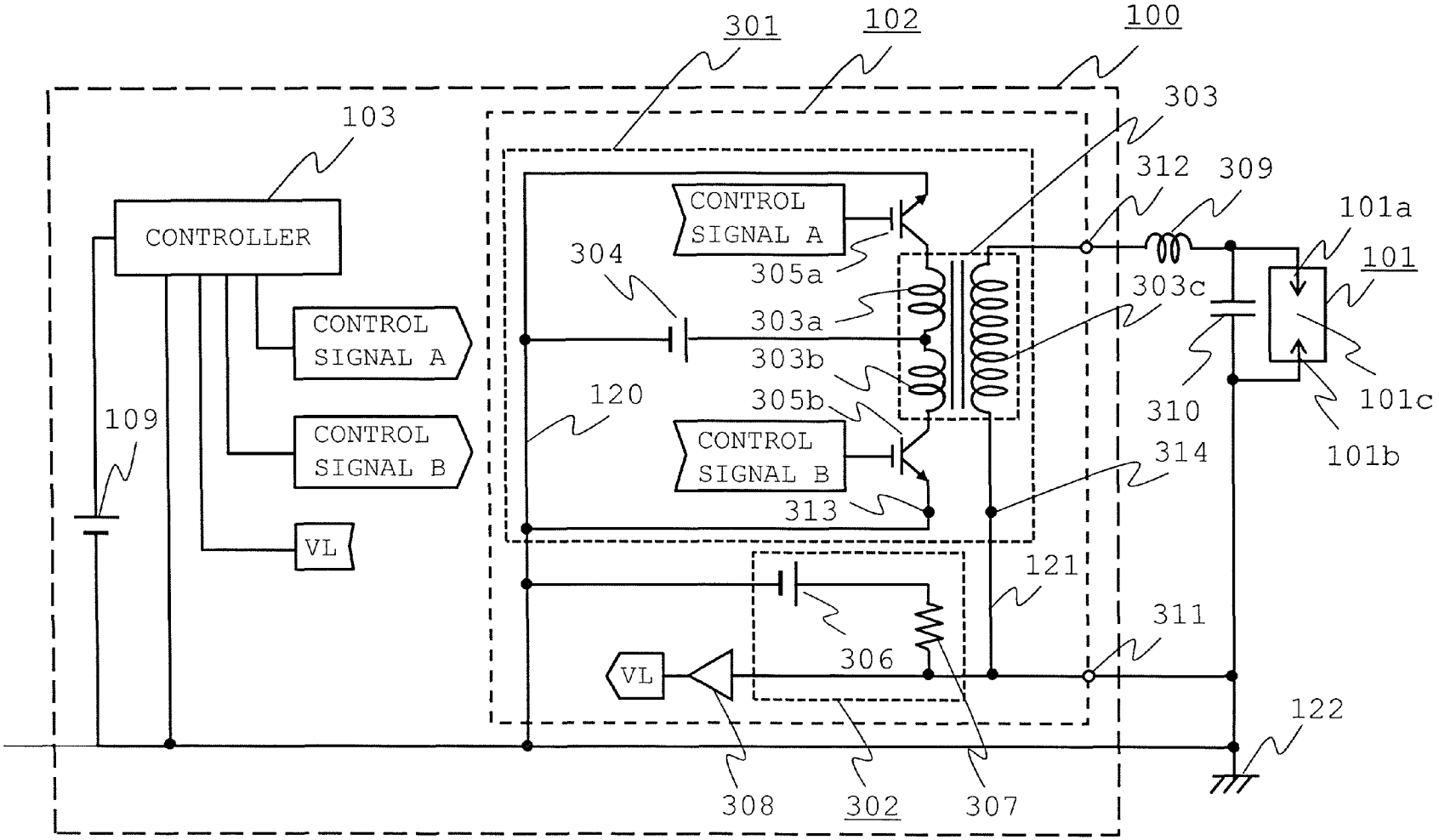
FIG. 3 is a circuit diagram showing the details of the structure of an example of the discharge device according to Embodiment 1.
Figures 4A, 4B, 4C, 4D:
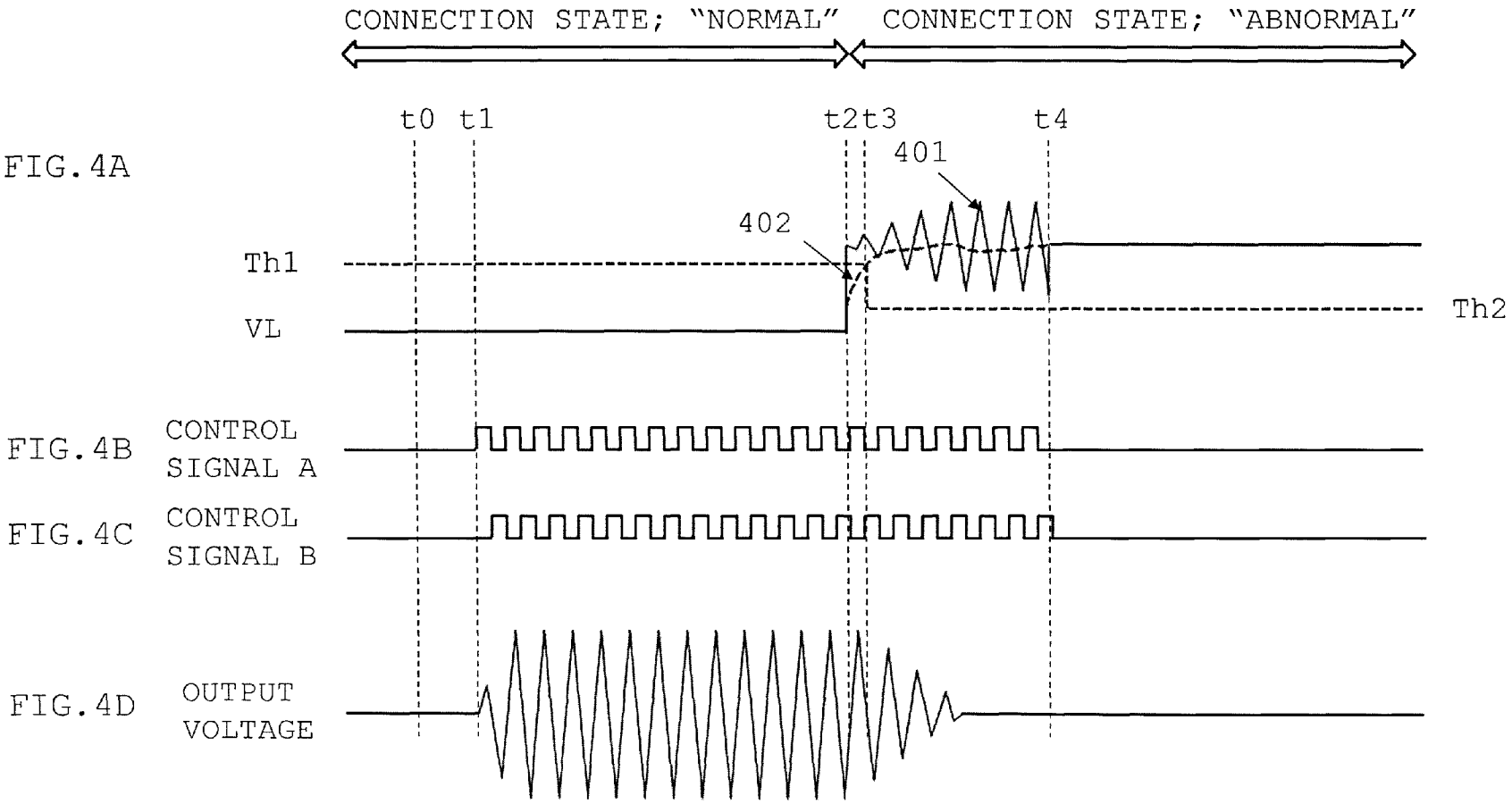
FIG. 4A to FIG. 4D are operation timing charts of the controller of the example according to Embodiment 1.

FIG. 1 is a circuit block diagram showing an outline of a structure of a discharge device according to Embodiment 1, FIG. 2 is a flowchart showing an operation procedure of a controller of the discharge device and FIG. 3 is a circuit diagram showing the details of the structure of an example of the discharge device. FIG. 4 A to FIG. 4D are operation timing charts of the controller of the example.

As shown in FIG. 1, a discharge device 100 includes a power supply device 102 supplying AC power for generating the discharge in a clearance 101*c* to a discharge load 101 having a high voltage electrode 101*a* and a grounding electrode 101*b* arranged to face the high voltage electrode 101*a* with the clearance 101*c* and connected to a ground GND 122 and a controller 103 controlling the power supply device 102

Here, the power supply device 101 includes a power supply (A) 104 using an internal GND (1) 120 as a reference, an output device 105 outputting AC power to be supplied to the discharge load 101 by the power supply (A) 104 by using an internal GND (2) 121 which is electrically separated from the internal GND (1) 120 as a reference, and a connection state detector 106 detecting a connection state between the internal GND (2) 121 and the ground GND 122.

The connection state detector 106 includes a power supply (B) 107 which makes a voltage using the internal GND (1) 120 as a reference and a pulldown resistance 108 arranged between the power supply (B) 107 and the internal GND (2) 121, outputting a detected voltage value V of the internal GND (2) 121.

The controller 103 determines the existence of an abnormality in the connection state between the internal GND (2) 121 and the ground GND 122 based on the voltage value V outputted from the connection state detector 106 and decides whether the power supply device 102 can supply AC power to the discharge load 101 or not. A DC power supply 109 is a power supply for the controller 103.

The internal GND (1) 120 and the ground GND 122 are connected in the outside of the power supply device 102.

Next, the operation of the controller 103 will be explained with reference to a flowchart showing an operation procedure of the controller shown in FIG. 2.

First, the controller 103 acquires a FLG as a last indicated value of the connection state for confirming a last determination result between the internal GND (2) 121 and the ground GND 122 in Step S201.

Subsequently, when the FLG is "0" as a result of confirming the state or the acquired FLG in Step S202, it is determined that the connection state is normal and the process proceeds to Step S203. When the FLG has a value other than "0", it is determined that the connection state is abnormal, and the process proceeds to Step S204.

In Step S203, a threshold Th1 is adopted as a determination threshold TH. In Step S204, a threshold Th2 is adopted as a determination threshold TH. After setting the determination threshold TH, the process proceeds to Step S205, respectively.

Here, the determination threshold TH is a determination threshold which is compared with a voltage equivalent value VL for determining whether the connection state is normal or abnormal. In the embodiment, the threshold TH is set to be divided into the threshold Th1 for determining that the state makes a transition from the normal state to the abnormal state and the threshold Th2 for determining that the state has returned from the abnormal state to the normal state for preventing wrong determination, hunting in determination and the like.

For example, when setting is made so that Th1<Th2, the sensitivity of determining the connection state will be increased. Although the sensitivity of determination can be increased, wrong determination may be increased or the hunting phenomenon in which determinations of normal and abnormal in the connection state are frequently repeated may be caused. On the other hand, when setting is made so that Th1>Th2, the sensitivity of determining the connection state will be reduced, however, wrong determination is reduced and determination processing can be stabilized.

In Step S205, the voltage equivalent value VL generated in the controller 103 is acquired based on the voltage value V of the internal GND (2) 121 from the connection state detector 106. Here, the voltage value V of the internal GND (2) 121 largely changes according to the connection state with respect to the ground GND 122, therefore, the voltage equivalent value VL obtained by smoothing the voltage value V of the internal GND (2) 121 is taken in the embodiment. There are many smoothing methods. In the embodiment, the voltage equivalent value VL is simply set to a primary filter value of an absolute value of the voltage value V as shown in Formula 1.

$$VL(n)=\alpha\times VL(n-1)+(1-\alpha)\times|V(n)| \quad (1)$$

$\alpha$ is a solid value lower than 1.

Subsequently, in Step S206, the voltage equivalent value VL of the internal GND (2) 121 obtained by Formula 1 is compared with the determination threshold TH. When THVL, it is determined that the connection state is normal, and the process proceeds to Step S207. When TH<VL, it is determined that the connection state is abnormal, and the process proceeds to Step S209.

In Step S207, as the connection state is determined to be normal, the flag is updated to FLG=0. In Step S208, the power supply from the power supply device 102 to the discharge load 101 is started. The determination processing of the connection state thus ends.

In Step S209, as the connection state is determined to be abnormal, the flag is updated to FLG=1. In Step S210, the power supply from the power supply device 102 to the discharge load 101 is stopped. The determination processing of the connection state thus ends.

In the embodiment, the controller 103 is provided with a smoothing device which smooths the voltage value V detected by the connection state detector 106 and outputs the value as the voltage equivalent value VL and a threshold setting device which sets the determination threshold TH for comparing the value with the voltage equivalent value VL.

The primary filter value of the voltage value V is set as the voltage equivalent value VL in the above explanation, however, a value itself at a given time obtained through a hardware filter built by a circuit can be adopted, and the same advantage can be obtained by adopting any of a peak value, an average value and an effective value within a given period.

Although the example in which a pull-up type voltage measuring device for measuring a voltage is used as the connection state detector 106 has been explained, a current measuring device for measuring a current using a current transformer and so on may also be adopted. When the current outputted from the power supply device 102 is returned through the current measuring device, the connection state can be determined to be normal, and when the current is returned not through the current measuring device, the connection state can be determined to be abnormal.

Next, the details of the operation will be further explained by using a specific example of the discharge device.

FIG. 3 shows a discharge device 100 as an example in which a connection state detector 302 according to the embodiment is combined with a so-called corona ignition device which is mainly used for automotive use and has been developed for stably igniting gasoline mixture in the engine. According to the combination, it is possible to prevent damage of apparatuses included in the discharge device 100 due to disconnection in an output path of AC power supplied from the discharge device 100 to the discharge load 101 and to suppress increase of radiation noise and so on. A discharge lamp such as a fluorescent lamp has a similar structure, and the same advantage can be obtained by combining the connection state detector according to the embodiment in the similar manner.

The discharge device 100 shown in FIG. 3 is roughly divided into the power supply device 102 supplying AC power for allowing the discharge load 101 to generate discharge and the controller 103 controlling the power supply device 102.

The power supply device 102 includes an inverter device 301 and a connection state detector 302. Here, the connection state detector 302 corresponds to the connection state detector 106 of FIG. 1.

The inverter device 301 includes a transformer 303 having a primary winding (A) 303*a*, a primary winding (B) 303*b* and a secondary winding 303*c*, a DC power supply (1) 304 connected between the primary winding (A) 303*a* and the primary winding (B) 303*b*, a switching IGBT (A) 305*a* connected to the primary winding (A) 303*a* on the opposite side of the DC power supply (1) 304 and a switching IGBT (B) 305*b* connected to the primary winding (B) 303*b* on the opposite side of the DC power supply (1) 304.

The connection state detector 302 includes a DC power supply (2) 306 for detecting the connection state and a pull-down resistance 307 connected between the DC power supply (2) 306 and the internal GND (2) 121. Here, the DC power supply (2) 306 corresponds to the power supply (B) 107 of FIG. 1.

The transformer 303 corresponds to the output device 105 of FIG. 1, and the DC power supply (1) 304 corresponds to the power supply (A) 104 of FIG. 1. The transformer is used as the output device 105 in the embodiment, however, the present invention can be realized by using a device such as a photo-coupler. In the embodiment, the DC power supply (1) 304 outputs 50 (V), the DC power supply (2) 306 outputs 5 (V) and a resistance value of the pull-down resistance 307 is 10 [kΩ].

The controller 103 acquires the voltage value V of the internal GND (2) 121 detected by the connection state detector 302 through a buffer device 308 to determine the connection state between the internal GND (2) 121 and the ground GND 122.

The operation of the discharge device 100 shown in FIG. 3 will be explained with reference to operation timing charts of the controller 103 of FIG. 4A to FIG. 4D and the flowchart showing the operation procedure of the controller 103 of FIG. 2. It is assumed that the connection state between the internal GND (2) 121 and the ground GND 122 is normal until a time t2, and an abnormality of the connection state occurs at the timing of the time t2. In the embodiment, the Th1=3[V] and Th2=2[V].

As the internal GND (2) 121 and the ground GND 122 are normally connected at a time t0, the voltage value V of the internal GND (2) 121 is almost "0 (zero)" [V], and the voltage equivalent value VL as the primary filter value obtained by smoothing the voltage value is also approximately "0 (zero)" [V] (Step S205). As the connection state is normally maintained and FLG=0, TH=Th1=3V. VL is smaller when the voltage equivalent value VL (≈0[V]) is compared with the determination threshold TH (=3[V]) (Step S206), therefore, the connection state is determined to be normal and FLG is continuously "0 (zero)" (Step S207).

The supply of power to the discharge load 101 is started from a time t1. The connection state is determined to be normal by the same determination also in the timing of the time t1, therefore, the controller 103 transmits a control signal A shown in FIG. 4A and a control signal B shown in FIG. 4B for supplying the power to the discharge load 101 to gates of the switching IGBT (A) 305*a* and the switching IGBT (B) 305*b* respectively, thereby starting the operation of the inverter device 301.

In response to the above, a primary current flows in the primary side of the transformer 303. For example, when a potential of the gate of the switching IGBT (A) 305*a* is set to "high" by the control signal A and a potential of the gate of the switching IGBT (B) 305*b* is set to "low" by the control signal B, the primary current flows in a path of the DC power supply (1) 304, the primary winding (A) 303*a*, the switching IGBT (A) 305*a* and the DC power supply (1) 304 in this order, and an induced voltage is generated in the secondary winding 303*c* of the transformer 303. For example, the current flows in a direction of the secondary winding 303*c*, a connection point (H) 312 and an inductor 309 in this direction.

On the other hand, when the potential of the gate of the switching IGBT (A) 305*a* is set to "low" by the control signal A and a potential of the gate of the switching IGBT (B) 305*b* is set to "high" by the control signal B, the primary current flows in a path of the DC power supply (1) 304, the primary winding (B) 303*b*, the IGBT (B) 305*b* and the DC power supply (1) 304 in this order, and the induced voltage is generated in the secondary winding 303*c* of the transformer 303. In this case, the current flows in a direction of the inductor 309, the connection point (H) 312 and the secondary wingding 303*c*.

In FIG. 3, a capacitance 310 indicates a stray capacitance 310 included in the discharge load 101. The stray capacitance 310 and the inductor 309 form an LC resonant circuit.

When switching periods of the switching IGBT (A) 305*a* and the switching IGBT (B) 305*b* are allowed to correspond to a resonant frequency of the LC resonant circuit by the control signal A and the control signal B, the power supply device 102 can output the AC current and can generate an output voltage shown in FIG. 4D in the high voltage electrode 101*a* of the discharge load 101 connecting to a middle point of the LC resonant circuit.

In the case where the output voltage exceeds a discharge voltage of the clearance 101*c* between the electrodes of the discharge load 101, the discharge is generated in the clearance 101*c*, therefore, ignition and combustion occurs when fuel is supplied to the engine, and the engine can be driven.

Here, a complete disconnection occurs at a connection point (L) 311 at a time t2. In the case where the secondary current is not capable of flowing, the output voltage to be generated in the high-voltage electrode 101*a* is reduced as shown in FIG. 4D. When the output voltage becomes lower than a discharge sustaining voltage in the clearance 101*c*, the discharge is stopped and ignition to the fuel does not occur, as a result, misfire is caused and the engine is stopped.

However, in the case of AC current output, the AC current is outputted from the connection point (H) 312 even when the complete disconnection occurs at the connection point (L) 311 though the output may be reduced, and the current flows in the LC resonant circuit and a sufficient output voltage can be supplied to the clearance 101*c*, as a result, the discharge may be maintained and the ignition state may also maintained.

For example, when a connection point (B) 313 and a connection point (C) 314 are capacitively coupled in the circuit or in the device, the output current may flow in a loop path of the secondary winding 303*c*, the connection point (H) 312, the inductor 309, the stray capacitance 310, the ground GND 122, the internal GND (1) 120, the connection point (B) 313, the connection point (C) 314 and the secondary winding 303*c* in this order.

In this case, the voltage of the connection point (B) 313 may increase depending on the coupling capacity between the connection point (B) 313 and the connection point (C) 314.

Accordingly, when the voltage of the connection point (B) 313 is rapidly increased, damage may be caused at the gate of the switching IGBT (B) 305*b* or the like, that is, the risk that the power supply device 102 fails is increased. There is a case where a loop area in which the current flows is extremely increased. The risk that the output current flows on the wiring to which an electromagnetic shield is not performed is generated, and the risk of largely increasing the radiation noise to cause adverse effects on peripheral devices is increased. Therefore, the disconnection in the connection point (L) 311 is a phenomenon which should be detected.

In the discharge device 100 according to the embodiment, when the disconnection occurs in the connection point (L) 311 at the time t2, the voltage value V in the internal GND (1) 121 is increased as shown by a solid line 401 of FIG. 4A. In the case of the example, the value will deviate in the vicinity of 5V. Therefore, the value obtained by smoothing the voltage value V, for example, the voltage equivalent value VL obtained through the primary filter is as shown by a dashed line 402 of FIG. 4A.

Referring to FIG. 4A, values of the voltage equivalent value VL and the threshold Th1 become equal at a time t3. The voltage equivalent value VL is compared with the threshold Th1 in accordance with the flowchart shown in FIG. 2, and when the voltage equivalent value VL exceeds the threshold Th1, the connection state is determined to be abnormal (Step S206). Subsequently, the FLG is changed to "1" (Step S209). Accordingly, the supply of power to the discharge load 101 is stopped and the transmission of the control signal A and the control signal B is stopped (Step S210).

The example in which the supply of power is not stopped by one determination is written in FIG. 4 A to FIG. 4D. The determination is performed plural times after the time t3. At a time t4 when the connection state is successively determined to be abnormal plural times or when the cumulative number of abnormalities in the connection state is larger than the given number of times, the supply of power is stopped and the output of the control signal A and the control signal B is stopped. Concerning the determination threshold TH, the FLG is changed to "1" at the time t3, therefore, determination is made by using the value of the threshold Th2 after that.

According to the above, the operation of the discharge device is stopped at the time of detecting the disconnection in the output path of the AC power to be supplied from the discharge device to the discharge load, thereby preventing damage in apparatuses of the discharge device and suppressing the increase of radiation noise and so on, which can prevent occurrence of a secondary disaster and can perform processing safely by setting a failure flag or by turning on an indicator lamp and so on to notify the operator of the abnormality of the discharge device or to prompt the operator to repair the device.

As described above, the discharge device according to Embodiment 1 has a function of accurately determining the disconnection in the output path of the AC power to be supplied from the discharge device to the discharge load or occurrence of a malfunction causing a connection failure, therefore, there are advantages that apparatuses included in the discharge device are protected from damage by stopping the operation of the discharge device when the malfunction occurs and the occurrence of secondary disasters can be prevented and suppressed.

Embodiment 2

Figure 5:
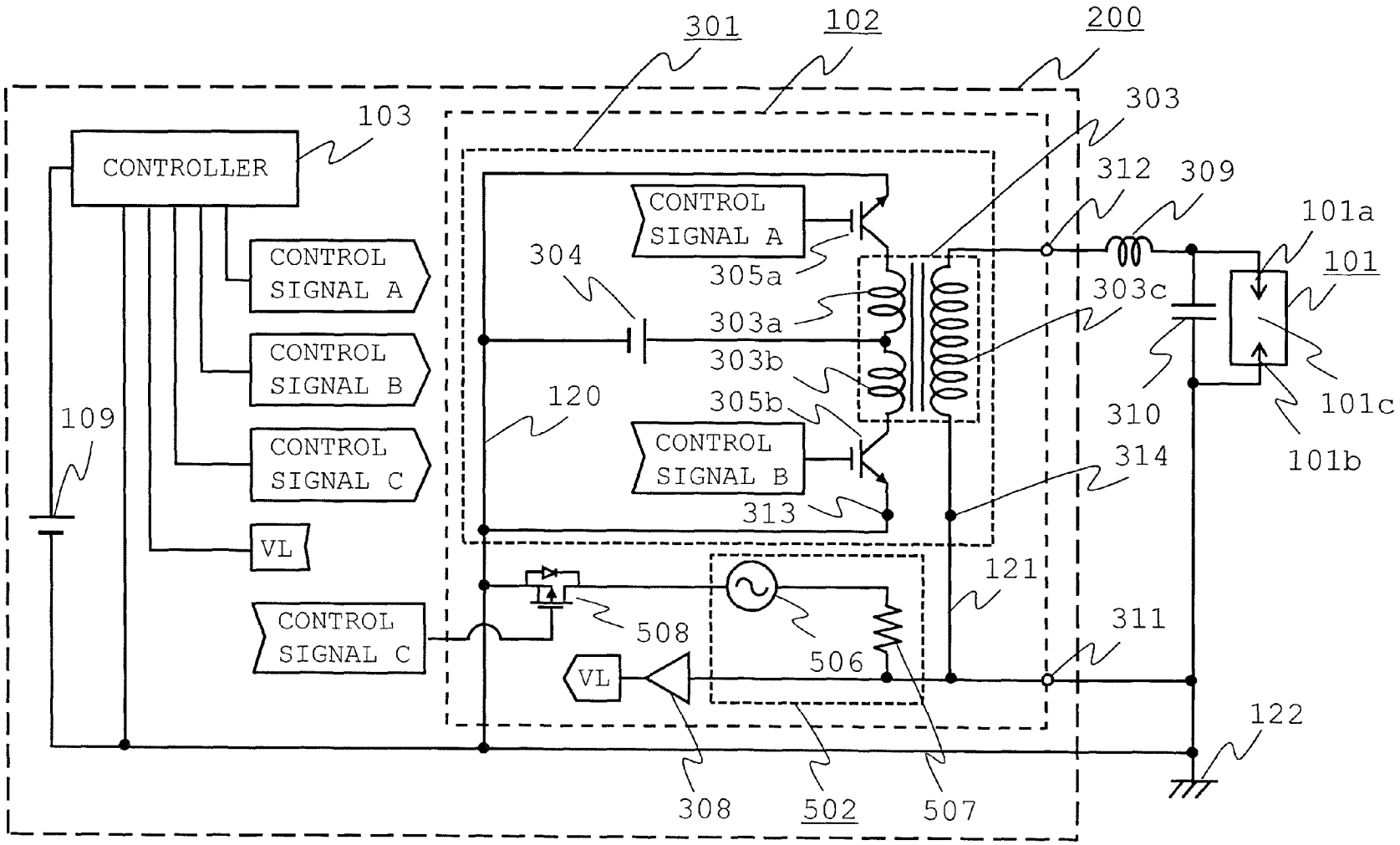
FIG. 5 is a circuit diagram showing the details of a structure of a discharge device according to Embodiment 2.
Figures 6A, 6B:
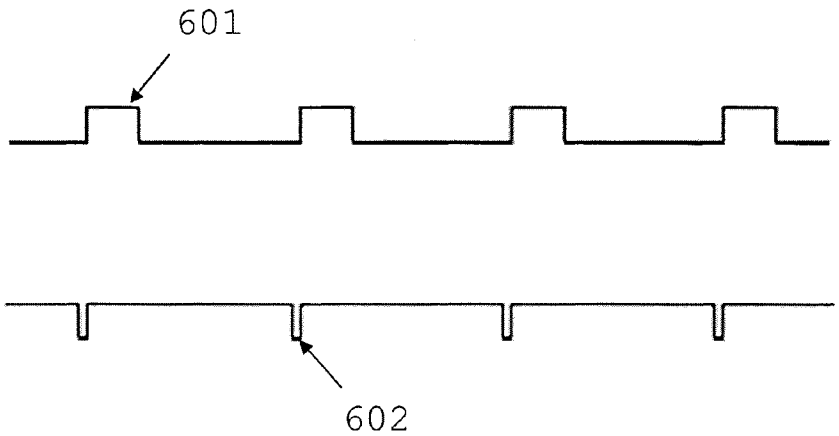
FIG. 6A and FIG. 6B show operation timing charts of a controller according to Embodiment 2.

FIG. 5 is a circuit diagram showing the details of a structure of a discharge device according to Embodiment 2, and FIG. 6A and FIG. 6B show operation timing charts of a controller of the discharge device. The power supply (B) 107 for detecting the connection state corresponds to the DC power supply (2) 306 in the example of Embodiment 1, however, the structure differs from the structure of the discharge device according to Embodiment 1 in a point that the power supply (B) 107 is changed to an AC power supply 506 in a discharge device 200 according to Embodiment 2. Furthermore, a switching device 508 for controlling the AC power supply 506 is added. As other components are the same as those of Embodiment 1, explanation thereof is omitted.

The connection point (L) 311 is assumed to be completely disconnected in Embodiment 1, however, there exists a state in which the connection is incompletely made, namely, an almost disconnected state, which is not the complete disconnection or the complete connection. When the voltage value V of the internal GND (2) 121 is measured in such state, approximately 0[V] is measured.

The power supply device 102 supplies AC power to the discharge load 101. When an AC frequency becomes high, it is difficult to ignore the effect of a contact area at a connection point, for example, in an AC frequency higher than MHz. In such a frequency band, the current can be regarded as an inductance component in the incomplete connected state. That is, the current can be seen as a high impedance with respect to a high-frequency AC component, therefore, there arise a case where the current does not pass through the connection position, a case where the current pass through both of the connection position and the path from the connection point (B) 313 to the connection point (C) 314 shown in the example of Embodiment 1 or case where the current pass through other plural positions, which may increase the risk of causing the failure of the discharge device and increasing the radiation noise. Accordingly, it is necessary to perform detection and to stop the supply of power to the discharge load 101 also when the above-described incomplete connection state remains.

A connection state detector 502 can determine the connection state by the controller 103 as described above by replacing the DC power supply (2) 306 in the example of Embodiment 1 with the AC power supply 506. When a frequency of the AC power supply 506 is set to be equivalent to an operation frequency of the inverter device 301, or set to be higher than the equivalent frequency for increasing the detection sensitivity, an effect by the increase of the impedance in the connection point (L) 311 can be detected.

For example, when an operation frequency of the inverter device 301 is 1 [MHz], a peak voltage of the AC power supply 506 is 5 [V], a frequency thereof is 10 [MHz], a resistance value of the pull-down resistance 507 is 100[Ω], a DC resistance of the connection point (L) 311 is 0[Ω] and an inductance thereof is 1 [μH], an impedance at a frequency 10 [MHz] in the connection point (L) 311 is approximately 60[Ω].

In the above connection state, the voltage value V of the internal GND (2) 121 is a sine wave with a peak value of approximately 2.7[V], an effective value thereof is approximately 1.9[V]. When the effective value is used as the voltage equivalent value VL and the threshold Th1 is set to 1[V], the connection state can be detected.

However, when the resistance value of the pull-down resistance 507 is set to a relatively small value for increasing the detection sensitivity of the connection state, it is difficult to ignore power consumption used for detecting the connection state. Therefore, the supply of power from the AC power supply 506 is limited to a period during which the connection state is detected in the above case, and the supply of power from the AC power supply 506 is not performed during periods except for the period during which the connection state is detected.

For example, a FET 508 as the switching device 508 is interposed between the path of the AC power supply 506, and the FET 508 is controlled from the controller 103. FIG. 6A and FIG. 6B show examples of timings when the detection of the connection state and the supply of power to the discharge load 101 are performed by the controller 103. A signal 601 in the drawing shows a timing of the supply of power, in which the power is supplied when the level is "high". A signal 602 in the drawing a pattern of a control signal C for controlling the FET 508 at the time of detecting the connection state, in which the detection of the connection state is performed when the level is "low". That is, the detection of the connection state is performed at the timing just before the supply of power for a short period of time. During the supply of power, the detected voltage value V may be largely deviated and the risk of an error detection and so on is relatively high, therefore, the detection of the connection state is not performed during the supply of power.

The abnormality can be detected also in the incomplete connection state. When the abnormality in the connection state is detected, the supply of power to the discharge load is stopped, and the discharge device can be stopped without failure, which can prevent occurrence of a secondary disaster and can perform processing safely by setting a failure flag or by turning on an indicator lamp and so on to notify the operator of the abnormality of the discharge device or to prompt the operator to repair the device.

As described above, the AC power supply is used for the power supply of the connection state detector which detects the connection state in the discharge device according to Embodiment 2, therefore, the disconnection in the output path of the AC power to be supplied from the discharge device to the discharge load or occurrence of a malfunction of the connection failure can be detected more accurately, and there are advantages that apparatuses included in the discharge device are protected from damage by stopping the operation of the discharge device and the occurrence of secondary disasters can be prevented and suppressed.

While the presently preferred embodiments of the present invention have been shown and described. It is to be understood that these disclosures are for the purpose of illustration and that various changes and modifications may be made without departing from the scope of the invention as set forth in the appended claims.

The same symbols in the drawing show the same or equivalent portions.

What is claimed is:

1. A discharge device comprising:

a power supply device to supply an AC power to a discharge load including a high-voltage electrode and a grounding electrode arranged to face the high-voltage electrode with a clearance and connected to a load ground (GND); and a controller to control a supply of the AC power, wherein the power supply device includes:

a first power supply to generate the AC power based on a first internal GND serving as a reference, an output device to output the AC power, which is generated by the first power supply, to the discharge load via a connection line connected to a second internal GND which is different from the first internal GND, and a connection state detector to detect a connection state of the connection line between the second internal GND and the load GND, wherein the connection state detector includes:

a second power supply to generate voltage based on the first internal GND serving as the reference, and a resistance device connected to the second power supply and to the connection line between the second internal GND and the load GND to detect the connection state of the connection line, and wherein the controller determines an existence of an abnormality in the connection state based on an output of the connection state detector and determines whether the AC power can be supplied to the discharge load or not.

2. The discharge device according to claim 1, wherein the second power supply comprises an AC power supply.

3. The discharge device according to claim 2, wherein the AC power supply has a higher frequency than a frequency of the AC power generated by the second power supply.

4. The discharge device according to claim 1, wherein the output device includes a transformer.

5. The discharge device according to claim 1, wherein the controller determines the existence of the abnormality in the connection state while the AC power is not supplied to the discharge load from the power supply device.

6. The discharge device according to claim 1, wherein the controller is configured to output a smoothed value obtained by smoothing the output of the connection state detector, and to set a threshold to be compared with the smoothed value, wherein the connection state is determined to be abnormal when the smoothed value is higher than the threshold.

7. The discharge device according to claim 2, wherein the controller is configured to output a smoothed value obtained by smoothing the output of the connection state detector, and to set a threshold to be compared with the smoothed value, wherein the connection state is determined to be abnormal when the smoothed value is higher than the threshold.

8. The discharge device according to claim 3, wherein the controller is configured to output a smoothed value obtained by smoothing the output of the connection state detector, and to set a threshold to be compared with the smoothed value, wherein the connection state is determined to be abnormal when the smoothed value is higher than the threshold.

9. The discharge device according to claim 1, wherein the controller instructs the second power supply to detect the connection state to feed power only when the existence of the abnormality in the connection state is determined.

10. The discharge device according to claim 2, wherein the controller instructs the second power supply to detect the connection state to feed power only when the existence of the abnormality in the connection state is determined.

11. The discharge device according to claim 3, wherein the controller instructs the second power supply to detect the connection state to feed power only when the existence of the abnormality in the connection state is determined.

* * * * *